US009957768B2

(12) United States Patent
Van Wijk et al.

(10) Patent No.: US 9,957,768 B2
(45) Date of Patent: May 1, 2018

(54) SUBSEA PRESSURE REDUCTION SYSTEM

(71) Applicant: Cameron International Corporation, Houston, TX (US)

(72) Inventors: Johannes Van Wijk, GS Rijswijk (NL); David J. McWhorter, Magnolia, TX (US); Melvyn F. Whitby, Houston, TX (US); Edward C. Gaude, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days. days.

(21) Appl. No.: 14/861,598

(22) Filed: Sep. 22, 2015

(65) Prior Publication Data

US 2016/0010418 A1 Jan. 14, 2016

Related U.S. Application Data

(62) Division of application No. 13/654,607, filed on Oct. 18, 2012, now Pat. No. 9,140,090.

(60) Provisional application No. 61/548,949, filed on Oct. 19, 2011.

(51) Int. Cl.

| | |
|---|---|
| ***E21B 33/035*** | (2006.01) |
| ***E21B 33/06*** | (2006.01) |
| ***E21B 33/064*** | (2006.01) |
| *F15B 3/00* | (2006.01) |
| *F15B 11/032* | (2006.01) |

(52) U.S. Cl.

CPC ..... *E21B 33/0355* (2013.01); *E21B 33/061* (2013.01); *E21B 33/064* (2013.01); *F15B 3/00* (2013.01); *F15B 11/032* (2013.01)

(58) Field of Classification Search

CPC .. E21B 33/0355; E21B 33/061; E21B 33/064; F15B 11/032; F15B 3/00

See application file for complete search history.

(56) References Cited

U.S. PATENT DOCUMENTS

| | | | | |
|---|---|---|---|---|
| 4,845,982 A * | 7/1989 | Gilbert | E21B 23/04 166/264 |
| 5,337,561 A * | 8/1994 | Raghavan | F15B 3/00 60/421 |
| 6,192,680 B1 * | 2/2001 | Brugman | E21B 33/0355 60/398 |
| 6,295,914 B1 * | 10/2001 | Iversen | F15B 3/00 417/403 |

(Continued)

*Primary Examiner* — James G Sayre
(74) *Attorney, Agent, or Firm* — Helene Raybaud

(57) ABSTRACT

A system for reducing pressure in a subsea operator. In one embodiment, a subsea system includes an operator and a deintensifier. The operator includes a housing and a piston. The piston is movably disposed within the operator housing and divides an inner volume of the operator housing into a closing chamber and a second chamber. The deintensifier is fluidically coupled to the operator. The deintensifier includes a housing and a piston. The piston includes a closing surface and an opening surface. The closing surface is fluidically coupled to the second chamber of the operator housing. The opening surface is fluidically coupled to ambient pressure. The area of the closing surface is greater than an area of the opening surface so as to increase the pressure differential between the closing chamber and the second chamber and assist in moving the operator piston to the closed position.

26 Claims, 16 Drawing Sheets

(56) References Cited

U.S. PATENT DOCUMENTS

| | | | | |
|---|---|---|---|---|
| 8,037,678 | B2 * | 10/2011 | McBride | F15B 1/024 60/412 |
| 2008/0267786 | A1 * | 10/2008 | Springett | E21B 33/0355 417/53 |
| 2009/0317267 | A1 * | 12/2009 | Gill | F15B 3/00 417/53 |
| 2010/0155072 | A1 * | 6/2010 | Gustafson | E21B 33/0355 166/335 |

* cited by examiner

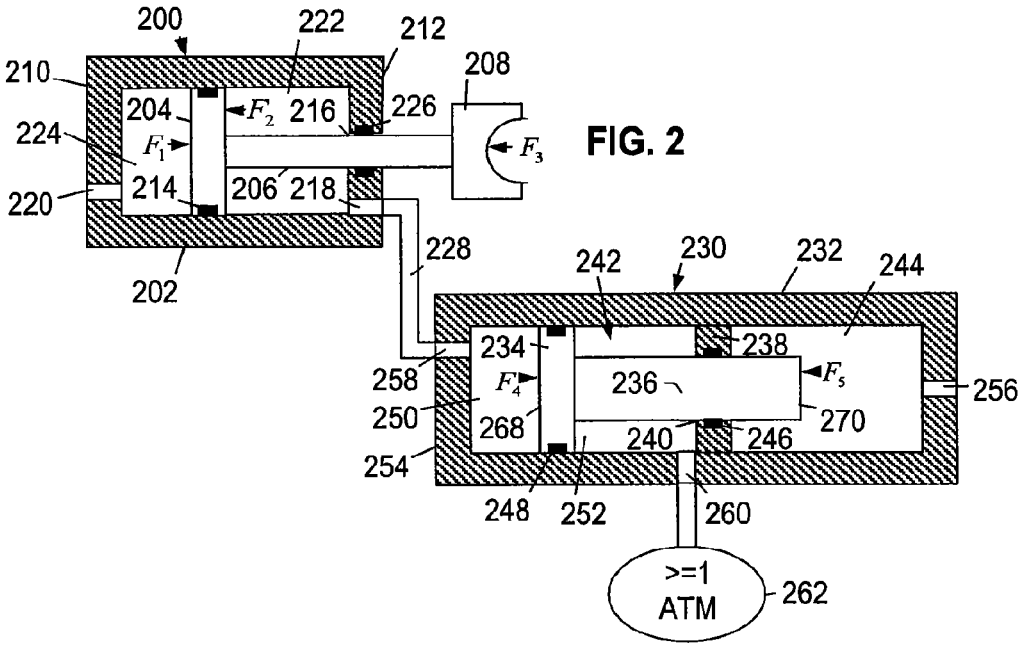
FIG. 2
FIG. 4
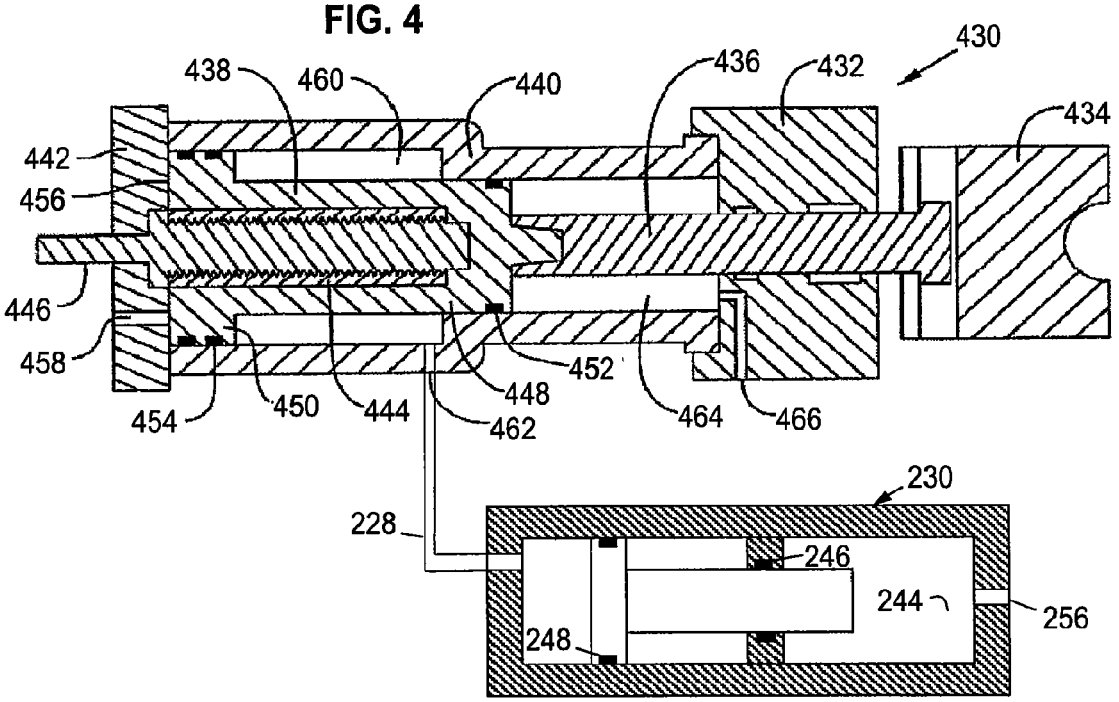

SUBSEA PRESSURE REDUCTION SYSTEM

BACKGROUND

Subsea equipment is typically hydraulically actuated. To effect actuation, deepwater accumulators often provide a supply of pressurized working fluid that helps control and operate the subsea equipment. This pressurized working fluid (e.g., hydraulic fluid) may be used to operate underwater process valves and connectors, and/or to manage fluid power and electrical power on subsea drilling BOP stacks, subsea production Christmas trees, workover and control systems (WOCS), and subsea chemical injection systems, to name but a few possibilities.

Accumulators are typically divided vessels with a gas section and a hydraulic fluid section of adjustable volumes. Accumulators operate on a common principle: The gas section is precharged with a gas at a pressure equal to or slightly below the anticipated minimum pressure required to operate the subsea equipment. As working fluid is added to the accumulator in the separate hydraulic fluid section, the volume of that section increases. In turn, the volume of the gas section is reduced, thus increasing the pressure of the gas and the hydraulic fluid. The hydraulic fluid introduced into the accumulator is therefore stored at a pressure at least as high as the precharge pressure and is available for doing hydraulic work.

The precharge gas can be said to act as a spring that is compressed when the gas section is at its lowest volume/greatest pressure and released when the gas section is at its greatest volume/lowest pressure. Accumulators are typically precharged in the absence of hydrostatic pressure, and the precharge pressure is limited by the pressure containment and structural design limits of the accumulator vessel under surface (ambient) conditions. Yet, the efficiency of conventional accumulators decreases in deeper waters because hydrostatic pressure and lower temperatures can cause the non ideal gas to compress, leaving a progressively smaller amount of useable volume of hydraulic fluid to power the subsea equipment's functions. The gas section must consequently be designed such that the gas still provides enough power to operate the subsea equipment under hydrostatic pressure even as the hydraulic fluid approaches discharge and the gas section is at its greatest volume/lowest pressure.

For example, BOP mounted accumulators at the surface typically provide 3000 psi of working fluid maximum pressure. At a depth 1000 feet below the sea surface, the ambient pressure (i.e., hydrostatic pressure) is approximately 465 psi. Thus, to provide a 3000 psi of differential pressure at a depth of 1000 ft, the accumulator has a precharge of 3465 psi, which is 3000 psi plus 465 psi. At a depth of slightly over 4000 ft., the ambient pressure is almost 2000 psi, making the effective precharge 5000 psi, which is 3000 psi plus 2000 psi. This would mean that the surface precharge would equal the working pressure of the accumulator, and any fluid introduced for storage or temperature increase after precharge may cause the pressure to exceed the working pressure and significantly degrade performance of the accumulator.

At progressively greater hydrostatic operating pressures, the accumulator thus has greater pressure containment requirements than at non-operational (no ambient hydrostatic pressure) conditions. The inefficiency of precharging accumulators under non-operational conditions thus requires large aggregate accumulator volumes that increase the size and weight of the subsea equipment. With rig operators increasingly putting a premium on minimizing size and weight of the drilling equipment to reduce drilling costs, the size and weight of all drilling equipment must be optimized. With deeper drilling depths, more and larger accumulators are required, increasing not only the size and weight of the subsea equipment, but also the rig equipment used for transport and handling of the subsea equipment.

Accumulators may be included, for example, as part of a subsea BOP stack assembly assembled onto a subsea wellhead. Fluid pressure, supplied by the accumulators can be used to operate the rams of the BOP. The BOP assembly may include a frame, BOPs, and accumulators to provide hydraulic fluid pressure for actuating the rams. The space available for other BOP package components such as remote operated vehicle (ROV) panels and mounted controls equipment is being reduced due to the increasing number and size of the accumulators required to for operation in deeper water depths. When a function of a subsea control system is activated, most of the high pressure fluid stored in the subsea or surface accumulators is used to move the function to the close position or the shear rams onto the pipe. It is desirable to minimize use of the high pressure stored fluid for movement of the function, but use it to actually perform the work to create a seal or shear the pipe as this will reduce the amount of accumulators that have to be installed on surface and on the BOP stack. Consequently, techniques for reducing the fluid pressure and high pressure fluid volume requirements of subsea equipment, and correspondingly reducing the need to increase surface and subsea accumulator capacity are desirable.

BRIEF DESCRIPTION OF THE DRAWINGS

For a detailed description of exemplary embodiments of the invention, reference will now be made to the accompanying drawings in which:

FIG. 2 shows a schematic diagram of a blowout preventer operator coupled to a deintensifier in accordance with various embodiments;

FIG. 4 shows a schematic diagram of a deintensifier coupled to a slack chamber of a hydraulic operator in accordance with various embodiments;

NOTATION AND NOMENCLATURE

Figure 1:
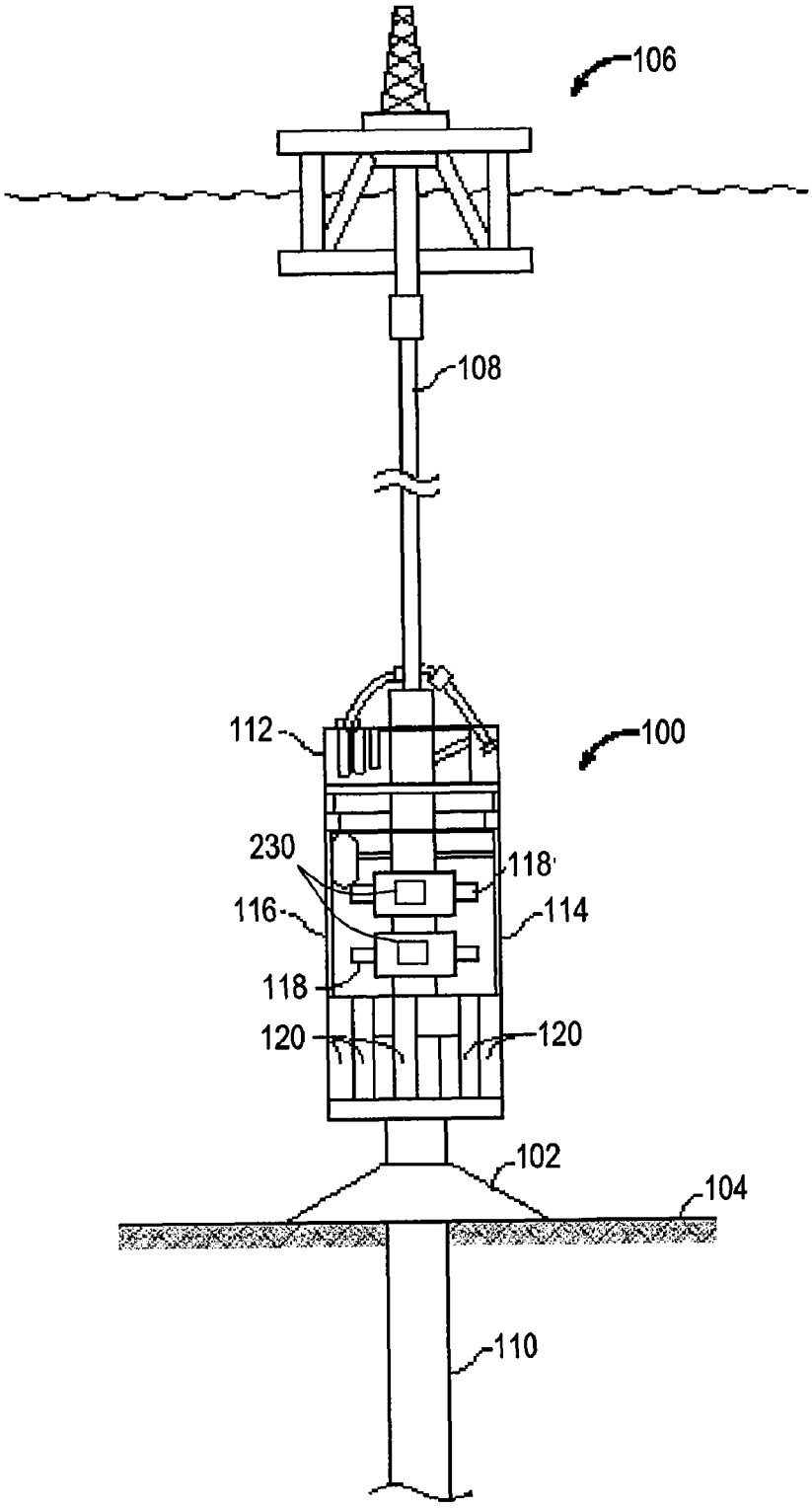
FIG. 1 shows a schematic diagram of a blowout preventer assembly coupled to a deintensifier in accordance with various embodiments.

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

DETAILED DESCRIPTION

The drawings and discussion herein are directed to various embodiments of the invention. Although one or more of these embodiments may be preferred, the embodiments disclosed are not intended, and should not be interpreted, or otherwise used, to limit the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment. The drawing figures are not necessarily to scale. Certain features of the invention may be shown exaggerated in scale or in somewhat schematic form, and some details of conventional elements may not be shown in the interest of clarity and conciseness.

As hydraulic equipment is operated at greater depths, it becomes increasingly difficult to supply adequate operational fluid pressure from the subsea accumulators associated with the equipment. The inefficiency of precharging accumulators results in undesirable increases in accumulator size and weight to achieve a prescribed fluid volume and pressure. Embodiments of the present disclosure include a deintensifier that alleviates the need to provide increasingly large accumulators. The deintensifier reduces the pressure in one or more chambers of a hydraulic device, thereby correspondingly reducing the fluid pressure required to operate the device, which may, in some systems, be provided by a subsea accumulator.

FIG. 1 shows a subsea blowout preventer (BOP) stack assembly 100 in accordance with various embodiments. The BOP stack assembly 100 is assembled onto a wellhead assembly 102 on the sea floor 104. The BOP stack assembly 100 is connected in line between the wellhead assembly 102 and a floating rig 106 through a subsea riser 108. The BOP stack assembly 100 provides pressure control of drilling/formation fluid in the wellbore 110 should a sudden pressure surge escape the formation into the wellbore 110. The BOP stack assembly 100 thus reduces the likelihood of damage to the floating rig 106 and the subsea riser 108 from fluid pressure exiting the seabed wellhead 102.

The BOP stack assembly 100 includes a BOP lower marine riser package 112 that connects the riser 108 to a BOP stack package 114. The BOP stack package 114 includes a frame 116, BOPs 118, and accumulators 120 that may be used to provide back up hydraulic fluid pressure for actuating the BOPs 118. In some embodiments, the BOPs 118 are ram-type BOPs, and in other embodiments, other types of BOPs, such as annular BOPs, may be included.

Some embodiments of the BOP stack 114 also include one or more deintensifiers 230. For example, a deintensifier 230 may be coupled to each ram of the BOP 118. As explained below, the deintensifier 230 reduces the pressure required to close the ram. Though illustrated herein with respect to a BOP, embodiments of the deintensifier 230 may be employed with any of a variety of fluid actuated subsea devices, such as Christmas trees, valves, and manifolds, to name a few.

FIG. 2 shows a schematic diagram of a blowout preventer operator 200 coupled to a deintensifier 230 in accordance with various embodiments. The operator 200 includes a housing 202, a piston 204, a rod 206, and a closure member 208. The interior of the housing 202 may be generally cylindrical, and the end plates 210, 212 of the housing 202 may be respectively formed by the head and bonnet of the blowout preventer 118. The piston seal 214 circumferentially surrounds the piston 204 and sealingly engages the interior surface of the housing 202.

The engagement of the piston seal 214 with the interior surface of the housing 202 divides the interior of the operator 200 into two hydraulically isolated chambers—opening chamber 222 and closing chamber 224. Opening chamber 222 is formed between end plate 212 and piston seal 212. Closing chamber 224 is formed between end plate 201 and piston seal 212.

The housing 202 includes an opening port 218 and a closing port 220 for communicating fluid into and/or out of the operator 200. The opening port 218 provides hydraulic communication with the opening chamber 222. The closing port 220 provides hydraulic communication with the closing chamber 224. The housing 202 also includes a rod port 216 through which the rod 206 is extended and retracted. A rod seal 226 is circumferentially disposed within the rod port 216 to sealingly engage the rod 206.

In general, hydraulic fluid is introduced into the closing chamber 224 via the closing port 220 to force extension of the rod 206 from the operator housing 202 through the rod port 216. Similarly, hydraulic fluid is introduced into the opening chamber 222 via the opening port 218 to force retraction of the rod 206 into the operator housing 202 through the rod port 216. The flow of fluid through the opening port 218 and/or the closing port 202 may be regulated by a hydraulic control system comprising various fluid switches (i.e. valves) coupled to fluid sources/receptacles, such as subsea accumulators.

The opening chamber 222 of the operator 200 is coupled to the deintensifier 230 via a fluid coupling 228. The fluid coupling 228 may be, for example, a pipe, a hose, or other suitable fluid conduit. The deintensifier 230 includes a housing 232, a piston 234, and a mandrel 236. The diameter of the mandrel 236 is less than the diameter of the piston 234. The interior of the housing 232 may be generally cylindrical. The housing 232 includes an internal wall 238 that divides the interior of the housing 232 into a piston chamber 242 and a mandrel chamber 244. The internal wall 238 includes a mandrel port 240 through which the mandrel 236 travels between the piston chamber 242 and the mandrel chamber 244. A mandrel seal 246 is circumferentially disposed in the mandrel port 240 to sealingly engage the mandrel 236. The internal wall 238 in conjunction with mandrel 236 and mandrel seal 246 hydraulically isolate the mandrel chamber 244 and the piston chamber 242.

A piston seal 248 circumferentially surrounds the piston 234 and sealingly engages the interior surface of the housing 232. The engagement of the piston seal 248 with the interior surface of the piston chamber 242 divides the piston chamber 242 into two hydraulically isolated chambers—closing chamber 250 and slack chamber 252. Deintensifier closing chamber 250 is formed between end plate 254 and piston seal 248. Slack chamber 252 is formed between internal wall 238 and piston seal 248. Thus, the deintensifier closing chamber 250 includes a portion of the piston chamber 242 disposed on one side of the piston 234, and the slack chamber 252 includes a portion of the piston chamber 242 disposed on the other side of the piston 234.

The housing 232 includes an opening port 256 and a closing port 258 for communicating fluid into and/or out of the deintensifier 230. The opening port 256 provides hydraulic communication with the mandrel chamber 244. The closing port 258 provides hydraulic communication with the deintensifier closing chamber 250.

In general, hydraulic fluid is introduced into the deintensifier closing chamber 250 via the closing port 258 to force the mandrel 236 to travel from the piston chamber 242 to the mandrel chamber 244 through the mandrel port 240. Similarly, hydraulic fluid is introduced into the mandrel chamber 244 via the opening port 256 to force retraction of the mandrel 236 into the piston chamber 242 through the mandrel port 240. The flow of fluid through the opening port 256 and/or the closing port 258 and closing port 220 may be regulated by a hydraulic control system comprising various fluid switches (i.e. valves) coupled to fluid sources/receptacles. In some embodiments, the opening port 256 provides ambient hydrostatic pressure (i.e., the pressure exerted by the water column) to the mandrel chamber 244.

The housing 232 may also include a slack chamber port 260 that allows fluid communication with the slack chamber 252. A source of reduced fluid pressure may be coupled to the slack chamber 252 via the slack chamber port 260. For example, a chamber 262 having internal pressure of one atmosphere or greater may be coupled to the slack chamber 252 via the slack chamber port 260. Some embodiments of the chamber 262 include a pressure monitoring device such as an ROV pressure gauge with separator piston as known in the art. Embodiments of the deintensifier 230 depicted herein may forgo illustration of the chamber 262 coupled to the slack chamber port 262, but the presence and connection of the chamber 262 to the slack chamber port 262 is presumed in all such embodiments.

The deintensifier 230 reduces the pressure, and correspondingly reduces the force, applied to the piston 204 on the opening chamber side, thus causing movement of the piston 204 and expanding the volume of the closing chamber 224 and moving the rod 206. By reducing the pressure in the opening chamber 222, the deintensifier 230 reduces the pressure needed in the closing chamber 224 to close the operator 200 as compared to the opening chamber 222 being open to ambient hydrostatic pressure.

Considering the operator 200 without the deintensifier 230, to close the operator 200 (i.e., move the piston and rod towards the right), the force applied on the closing side of the piston 204 must be greater than the force applied on the opening side of the piston 204. The operative force applied to close the operator is the difference of the force $F_1$ applied to the piston 204 in the closing chamber, the force $F_2$ applied to the piston 204 in the opening chamber, and the force $F_3$ applied to the closure member 266 over the area of the rod 206. Thus, the closing force may be expressed as:

$$F_{CLOSE}=F_1-F_2-F_3$$

To effect movement, the deintensifier 230 increases the magnitude of $F_{CLOSE}$ for a given value of $F_1$, or alternatively, reduces the magnitude of $F_1$ needed to achieve a desired $F_{CLOSE}$. The deintensifier 230 effects these force changes by modifying $F_2$.

The difference in area of the deintensifier piston surface 268 and the mandrel surface 270 results in the force $F_4$ applied to the piston 234 being greater than the force $F_5$ applied to the mandrel 236 at a given fluid pressure. For example, if the area of the piston surface 268 is twice that of the mandrel surface 270, then at a given pressure applied to both the deintensifier closing chamber 250 and the mandrel chamber 244, the force $F_4$ on the piston 234 will be twice the force $F_5$ on the mandrel 236. Consequently, the total closing force $F_{CLOSE_DEINT}$ applied when using the deintensifier 230 may be expressed as:

$$F_{CLOSE_DEINT}=F_1-(F_2-(F_4-F_5))-F_3$$

Thus, the deintensifier 230 may greatly reduce the force $F_2$ applied to the piston 204 due to fluid pressure in the opening chamber 244 than if the same fluid pressure were in the opening chamber 222 without the deintensifier 230.

In terms of pressure, the deintensifier 230 lowers the fluid pressure in the opening chamber 222 compared to not having a deintensifier 230, thereby increasing the differential pressure across the piston 204. If a given pressure differential is required to extend the closure member 208 into position, then, depending on the water depth of the BOP 118, the deintensifier 230 can provide a substantial portion of the required pressure differential. This relieves the subsea accumulators 120 of the burden of providing the full required pressure differential, and possibly alleviates the need for more and/or larger accumulators, addition of boosters to the BOP 118, etc. Further, the deintensifier 230 and its control system can provide a differential closing pressure over piston 204 without even providing a close pressure from accumulators to port 220. This will reserve the high pressure fluid in the accumulators for initiation of the seal or shear and seal. Conversely, the pressure required to open the hydraulic operator 200 increases because of the use of the deintensifier and is equivalent to:

$$P_{OPEN_DEINT} = P_{OPEN}\left(\frac{Area_{PISTON}}{Area_{MANDREL}}\right)$$

where:

$Area_{PISTON}$ is the area of the deintensifier piston surface 268; and $Area_{MANDREL}$ is the area of the deintensifier mandrel surface 270.

The ratio of surface area of the mandrel surface 270 to the deintensifier piston closing surface 268 may be selected to optimize operation of the hydraulic operator 200. Smaller ratios yield a higher gain in differential pressure across the piston 204. Higher differential pressures may stress the piston seal 214. Embodiments provide control of the differential pressure via the selection of the mandrel-to-piston surface area ratio, and therefore, advantageously allow for control of the stress on the piston seal 214. In certain embodiments, the ratio of the surface area of the mandrel surface 270 to that of the piston surface 268 is limited to the maximum opening pressure that can be applied to deintensifier port 256.

Figure 3A:
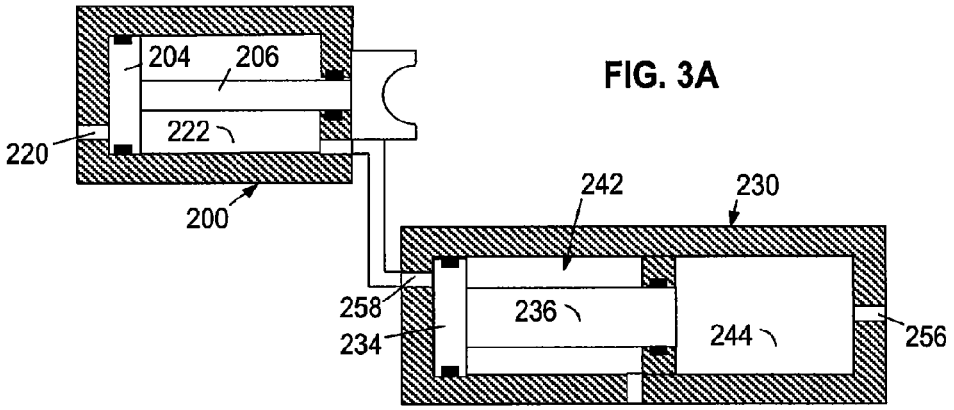
FIGS. 3A-3C show schematic diagrams of an operator and deintensifier in different states of closure in accordance with various embodiments.
Figure 3B:
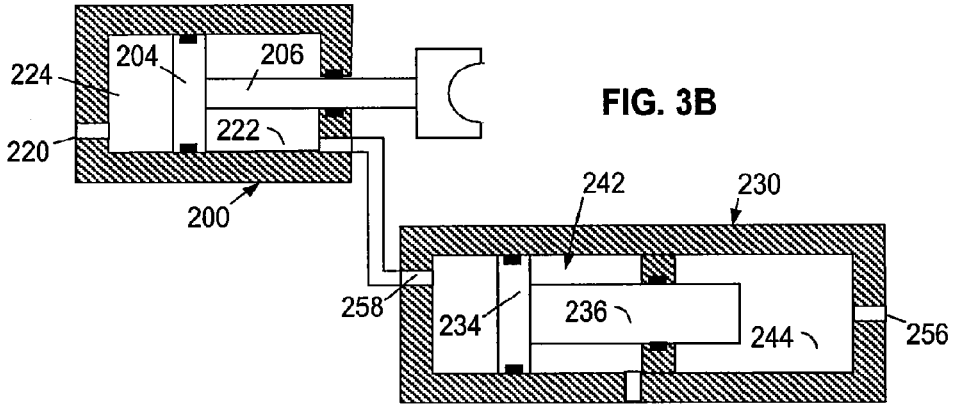
Figure 3C:
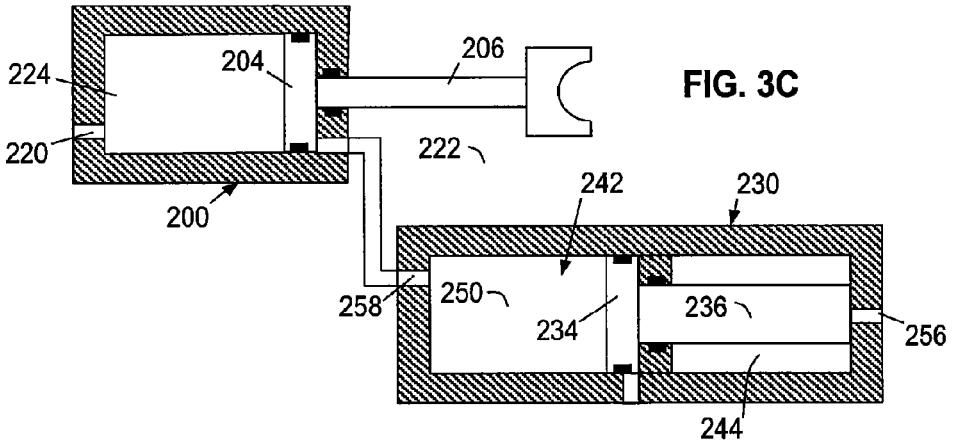

FIGS. 3A-3C show the operator 200 in the fully open, closing, and fully closed positions, respectively. In FIG. 3A the operator 200 and the deintensifier 230 are in the fully open position at a sea floor, for example. The rod 206 is fully retracted in the operator 200, and the mandrel 236 is fully retracted into the piston chamber 242 of the deintensifier 230. The closing port 220 of the operator 200 may be exposed to hydrostatic pressure. However, if there is a valve coupled to the opening port 256 of the deintensifier and that valve is closed, fluid in mandrel chamber 244 is unable to exit and, thus, is at a higher pressure to hold the system open as shown. Fluid in the opening chamber 222 of the operator 200 and the closing chamber 250 of the deintensifier 230 may also be at or close to hydrostatic pressure. The required opening pressure for operator assembly 200 is applied to port 256. The minimum pressure required ($P_{OPEN_DEINT}$) is described above.

In FIG. 3B, the operator 200 and the deintensifier 230 are closing. For example, the valve coupled to the opening port 256 of the deintensifier 230 is opened to reduce the pressure in the mandrel chamber 244 to that of ambient surrounding the deintensifier 230 (i.e., the mandrel chamber 244 is at hydrostatic pressure when located subsea). The reduction in mandrel chamber pressure correspondingly reduces the force $F_5$ applied to the mandrel 236, and the mandrel 236 begins to move into the mandrel chamber 244. That, in turn, moves deintensifier piston 234 and reduces the pressure in the opening chamber 222 and the force $F_2$ applied to the piston 204. With force $F_1$ generated by hydrostatic pressure, fluid pressure supplied by the accumulators 120, or other any other suitable source, the piston 204 moves in the closing direction, extending the rod 206 from the operator 200.

In FIG. 3C, the operator 200 and the deintensifier 230 are in the fully closed position. The rod 206 is fully extended from the operator 200, and the mandrel 206 is fully disposed in the mandrel chamber 244. The mandrel chamber 244 may be open to hydrostatic pressure via the opening port 256. The closing chambers 224 and 250 may also be at ambient hydrostatic pressure.

To return the operator 200 and the deintensifier 230 to the open configuration of FIG. 3A, fluid pressure may be supplied to the mandrel chamber 244 via the opening port 256. The supplied fluid pressure is sufficient to produce a force $F_5$ sufficient to overcome an opposing force produced by fluid pressure in the chamber 250, and the friction of the seals 246, 248, 216, and 214. In some embodiments, the fluid pressure supplied to open the operator 200 and the intensifier 230 may be supplied by a fluid pressure source at the surface and/or a subsea fluid pressure source. In an alternative embodiment, the opening fluid pressure may be supplied to opening chamber 222 of the operator 200 or slack chamber 252 of the deintensifier through appropriate porting.

FIG. 4 shows another embodiment of an operator system 430 coupled to the deintensifier 230. The illustrated operator system 430 is an EVO® BOP, which is available from Cameron International Corporation of Houston, Tex. and is described in U.S. Pat. Nos. 7,300,033, 7,338,027, 7,374,146, 7,533,865, and 7,637,474 which are hereby incorporated by reference for all purposes. The operator system 430 is mounted to a bonnet 432 and is coupled to a closure member 434. The closure member 434 may be a BOP ram, such as a shear ram, a blind ram, a pipe ram, to name a few. The operator system 430 includes piston rod 436, piston 438, operator housing 440, and head 442. Piston 438 comprises body 448 and flange 450. Body seal 452 circumferentially surrounds body 448 and sealingly engages operator housing 440. Flange seal 454 circumferentially surrounds flange 450 and sealingly engages operator housing 440. The sealing diameter of flange seal 454 is larger than the sealing diameter of body seal 452.

The engagement of body seal 452 and flange seal 454 with operator housing 440 divides the interior of the operator 430 into three hydraulically isolated chambers, closing chamber 456, slack fluid chamber 460, and opening chamber 464. Closing chamber 456 is formed between head 442 and flange seal 454. Closing port 458 provides hydraulic communication between the closing chamber 456 and fluid source/receptacle, such as an accumulator or the ambient environment. Slack fluid chamber 460 is formed in the annular region defined by operator housing 440 and piston 438 in between body seal 452 and flange seal 454. Slack fluid port 462 provides hydraulic communication with slack fluid chamber 460. Opening chamber 464 is formed in the annular region defined by operator housing 440 and piston 438 in between body seal 452 and bonnet 432. Opening port 466 provides fluid communication between the opening chamber 464 and fluid source/receptacle, such as an accumulator or the ambient environment.

The deintensifier 230 is coupled to the slack fluid port 462 of the operator 430 via the fluid coupling 228. In some embodiments, the deintensifier 230 may be connected to the opening port 466. In accordance with the operation described above, the deintensifier 230 increases the pressure differential between the slack chamber 460 and the closing chamber 456, thereby reducing the fluid pressure that must be supplied at the closing port 458 to extend the piston rod 436 and move the closure member 434 than if the slack chamber 460 were open to ambient hydrostatic pressure.

Consequently, closing the operator 430 follows a similar sequence to that described above with regard to the operator 200. The operator 430 may be held open by maintaining sufficient fluid pressure in the opening chamber 464 or the slack chamber 460. For example, a valve coupled to the opening chamber 464 may be closed to maintain opening fluid pressure in the opening chamber 464. When the valve is opened, the pressure in the opening chamber 464 is reduced, and the reduced pressure in the slack chamber 460, created by the deintensifier 230, reduces the closing chamber pressure needed to extend the piston rod 436.

The operator 430 may be returned to the open position by applying fluid pressure to the opening port 466. The fluid pressure must be sufficient to overcome the forces generated by the deintensifier 230 and the friction of the seals 454, 452, 248, and 246. When the operator 430 and the deintensifier 230 have been returned to the open position, fluid pressure may be maintained in the slack chamber 460 or the opening chamber 464 to sustain the open state. Thus, when employed with the hydraulic operator 430, embodiments of the deintensifier 230 may provide a mandrel chamber 244 that is continually open to hydrostatic pressure through the port 256. Alternatively port 256 can be connected to the port 466 to reduce the opening pressure of operator 430. As described below regarding FIG. 12, it is also possible to substitute a precharged accumulator for the deintensifier 230, which in the unique application to the EVO® BOP operator will create a similar closing force and increased open force as the 230 deintensifier.

Figure 5:
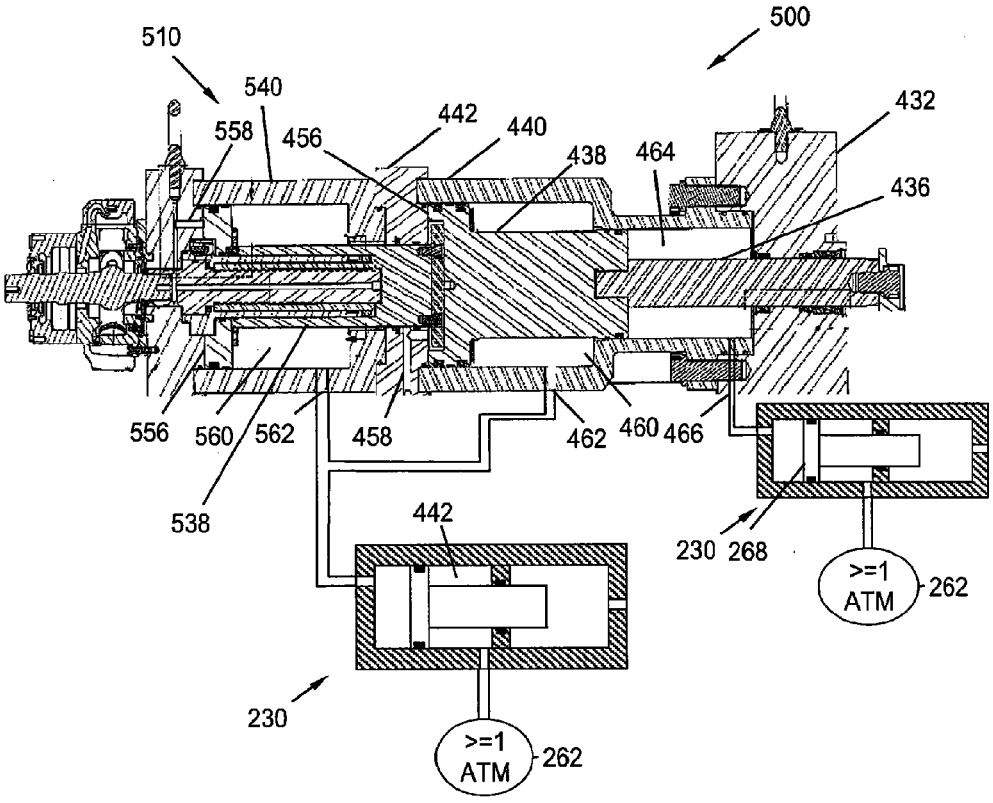
FIG. 5 shows a schematic diagram of a deintensifier coupled to a slack chamber and booster chamber of a hydraulic operator with a tandem booster in accordance with various embodiments.

FIG. 5 shows another embodiment of a subsea system with an operator 500 similar to the operator 430 shown in FIG. 4, with like parts being labeled as described above. The operator 500 further includes a tandem booster 510 attached to the operator 430 including a booster housing 540 and a booster piston 538 movably disposed within the booster housing 540 between and open position and a closed position. The booster piston 538 includes seals similar to the seals for the operator piston 438 and thus divides an inner volume of the booster housing 540 into a closing chamber 556 and an opening chamber 560. As shown, the booster piston 538 extends from the booster housing 540 and is coupled to the operator piston 438. Thus, as the booster piston 538 extends and retracts from the booster housing 540, it likewise acts to extend and retract the operator piston 438.

A first deintensifier 230 as described above is fluidically coupled to the tandem booster opening chamber 560 with the deintensifier closing chamber 250 being in fluid communication with the tandem booster opening chamber 560 through a tandem booster opening chamber port 562. Additionally, port 462 from the slack chamber 460 is connected to the same 230 deintensifier port as port 562.

A second deintensifier 230 is fluidically coupled to the operator opening chamber 464 with the second deintensifier piston closing surface 268 fluidically coupled to the operator opening chamber 464. Because the area of the second deintensifier piston closing surface 268 is greater than an area of the second deintensifier piston opening surface, the second deintensifier increases the pressure differential between the operator closing chamber 456 and the operator opening chamber 464 and assists in moving the operator piston 438 to the closed position. Alternatively the port 466 from the opening chamber 464 can also be connected to the same opening port as port 562 and 462 on the same deintensifier for system simplification. With the introduction of a second deintensifier unit, on the EVO Tandem Booster opening port 466, the opening pressure and closing force from the system can be precisely adjusted.

Both of the deintensifiers 230 may also include a slack chamber port that allows gas communication with the slack chamber 460. A source of reduced gas pressure may be coupled to the slack chamber 460 via the slack chamber port. For example, a chamber 262 having internal pressure of one atmosphere or greater may be coupled to the slack chamber 460 via the slack chamber port. Alternatively, as described below with respect to FIGS. 12, 13 and 14, the deintensifier unit 230 can be replaced with a precharged accumulator and the slack chamber ports from the EVO® actuator to create an increased closing force and an increased opening force.

Closing the operator 500 follows a similar sequence to that described above with regard to the operator 200 and 430. The operator 500 may be held open by maintaining sufficient fluid pressure in the opening chamber 464 or the slack chamber 460. For example, a valve coupled to the opening chamber 464 may be closed to maintain opening fluid pressure in the opening chamber 464. When the valve is opened, the pressures in the opening chamber 464, the slack chamber 460, and the booster opening chamber 560 are reduced due to the deintensifiers 230, and the reduced pressures reduce the closing chamber pressure needed to extend the piston rod 436.

The operator 500 may be returned to the open position by applying fluid pressure to the opening chamber 464, the slack chamber 460 and/or the tandem booster slack chamber 560. The fluid pressure must be sufficient to overcome the forces generated by the deintensifiers 230 and the friction of the seals 454, 452, 248, and 246. When the operator 500 and the deintensifiers 230 have been returned to the open position, fluid pressure may be maintained in the slack chamber 460, slack chamber 560 and/or the opening chamber 464 to sustain the open state. Multiple deintensifiers can be used in parallel or in series to create the required closing force and opening pressure.

Figure 6:
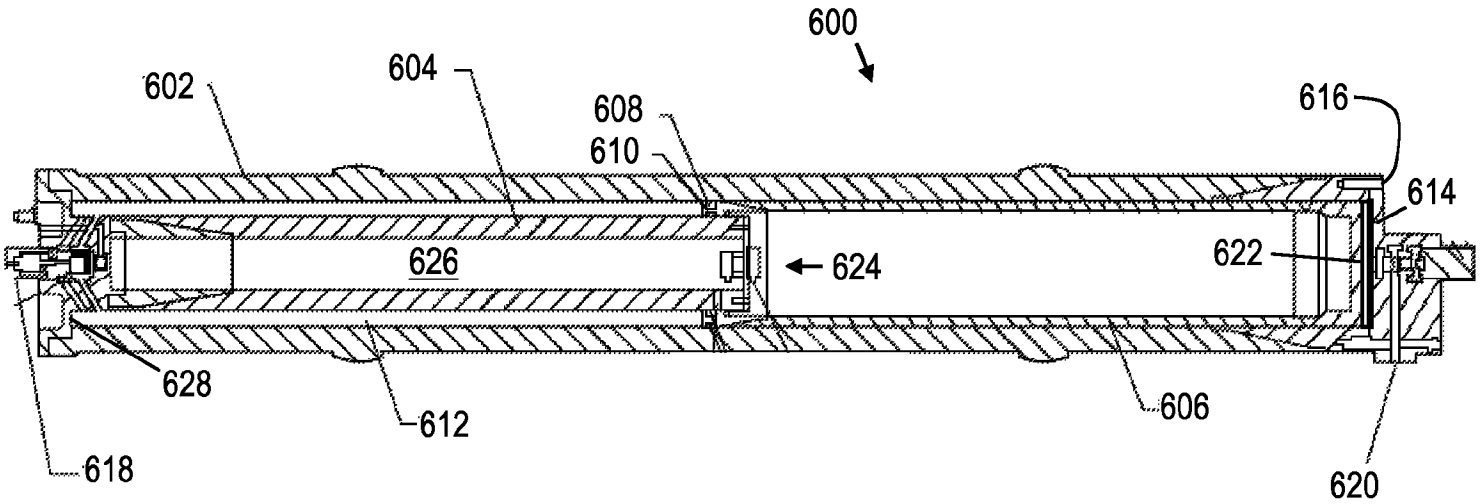
FIG. 6 shows a cross-sectional view of deintensifier that includes an annular piston in accordance with various embodiments.

FIG. 6 shows a cross-sectional view of a deintensifier 600 in accordance with various embodiments. The deintensifier 600 includes a housing 602, an inner barrel 604, and an annular piston 606 disposed in the annulus formed between the outer surface of the inner barrel 604 and the inner surface of the housing 602. A piston inner diameter seal 610 is circumferentially disposed about the inner surface of the piston 606 and sealingly engages the outer surface of the inner barrel 604. A piston outer diameter seal 608 is circumferentially disposed about the outer surface of the piston 606 and sealingly engages the inner surface of the housing 602.

The engagement of the piston seals 608, 610 with the outer surface of the inner barrel 604 and the inner surface of the housing 602 divides the interior of the deintensifier 600 into two hydraulically isolated chambers—opening chamber 612 and closing chamber 614. Chamber 612 is formed in the annulus between end plate 628 and piston seals 608, 610. Closing chamber 614 is formed between end plate 616 and piston seals 608, 610. The closing chamber 614 operates in a manner similar to the closing chamber 250 of deintensifier 230 illustrated in FIG. 2.

The annular piston 606 has a closed end 622 and an open end 624. The surface area of the closed end 622 exposed to fluid pressure in the closing chamber 614 is greater than the surface area of the open end 624 exposed to fluid pressure in the opening chamber 612. Consequently, the force generated at the closed end 622 is greater than the force generated at the open end 624 for a given fluid pressure within the closing chamber 614 and the opening chamber 612.

The housing 602 includes an opening port 618 and a closing port 620 for communicating fluid into and/or out of the deintensifier 600. The opening port 618 provides hydraulic communication with the opening chamber 612. The closing port 620 provides hydraulic communication with the closing chamber 614. In general, hydraulic fluid is introduced into the closing chamber 614 via the closing port 620 to force the piston 606 to travel towards the end plate 628. Similarly, hydraulic fluid is introduced into the opening chamber 612 via the opening port 618 to force the piston 606 to travel towards the end plate 616. The flow of fluid through the opening port 618 and/or the closing port 620 may be regulated by a hydraulic control system comprising various fluid switches (i.e. valves) coupled to fluid sources/receptacles. In some embodiments, the opening port 618 couples the opening chamber 612 to hydrostatic pressure (i.e., the pressure exerted by the water column).

A central cavity 626 is formed by the conjoined inner surfaces of the inner barrel 604 and the piston 606. The central cavity 626 may be filled with a low pressure gas, e.g., one atmosphere of nitrogen, and it operates in manner similar to the low pressure chamber 262 of the deintensifier 230 illustrated in FIG. 2

The closing port 620 of the deintensifier 600 may be fluidically coupled to the open port 218 of the operator 200, or to the slack fluid port 462 of the operator 430. With the opening port 618 of the deintensifier 600 coupled to ambient water pressure when installed subsea, the deintensifier 600 functions to reduce the force required to close the operator 200, 430 as described above with regard to the deintensifier 230.

Figure 7:
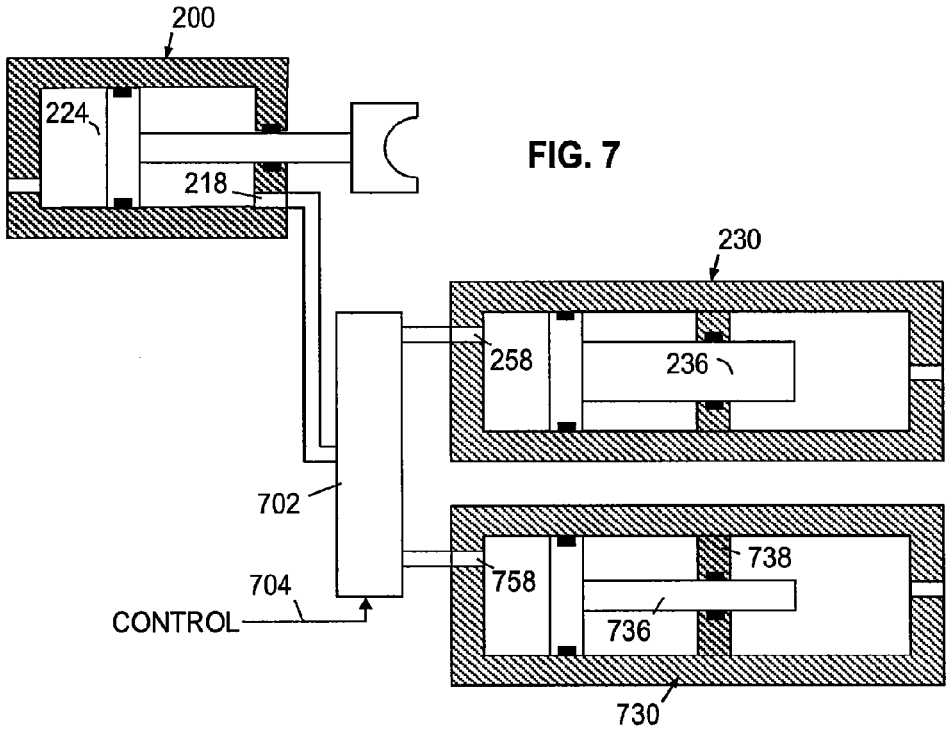
FIG. 7 shows a schematic diagram of a plurality of deintensifiers switchably coupled to a hydraulic operator in accordance with various embodiments.

FIG. 7 shows a schematic diagram of a plurality of deintensifiers 230, 730 switchably coupled to a hydraulic operator 200 in accordance with various embodiments. A switch 702 is coupled to the opening port 218 of the operator 200 and to the closing ports 258, 758 of the deintensifiers 230, 730. The switch 702 may be hydraulic, mechanical, electric, or any other suitable type of switch. The switch 702 includes valves that couple the operator 200 to either one of the deintensifiers 230, 730 using fluid switching means known to those skilled in the art. A control signal 704 may be provided to the switch 702 to select which of the deintensifiers 230, 730 is fluidically coupled to the operator 200. The control signal may be electrical, pneumatic, hydraulic, etc. as needed to actuate the valves of the switch 702.

The deintensifier 730 may be configured to provide a different ratio of forces from that provided by the deintensifier 230. For example, the mandrel 736 of deintensifier 730 may differ in diameter from the mandrel 236 of deintensifier 230. The narrower mandrel 736 provides a higher closing force for the operator 200 than the wider mandrel 236 with a given fluid pressure in closing chamber 224 of the operator 200. Conversely, because of the narrower mandrel 736, the deintensifier 730 requires a higher opening pressure than the deintensifier 230.

Various embodiments may select one of the deintensifiers 230, 730 based on a desired closing force for the operator 200, or based on a desired opening force for the operator 200. For example, if the operator 200 is closed using the deintensifier 230, some embodiments may disconnect the operator 200 from the deintensifier 230 and connect the operator 200 to the deintensifier 730 after closure. Connection of the closed operator 200 to the deintensifier 730 increases the fluid pressure (relative to deintensifier 230) required to open the operator 200, and can effectively lock the operator 200 in the closed position. In some embodiments, such a system may be used in lieu of or to supplement mechanical locks associated with the operator 200.

In an alternative embodiment, the slack port of the hydraulic operator 430 may be coupled to plurality of deintensifiers 230, 730 via the hydraulic switch 702. Those skilled in the art will understand that, in practice, any number of different deintensifiers by be coupled to the hydraulic operator 200, 402 via a suitable hydraulic switch 702.

Figure 8:
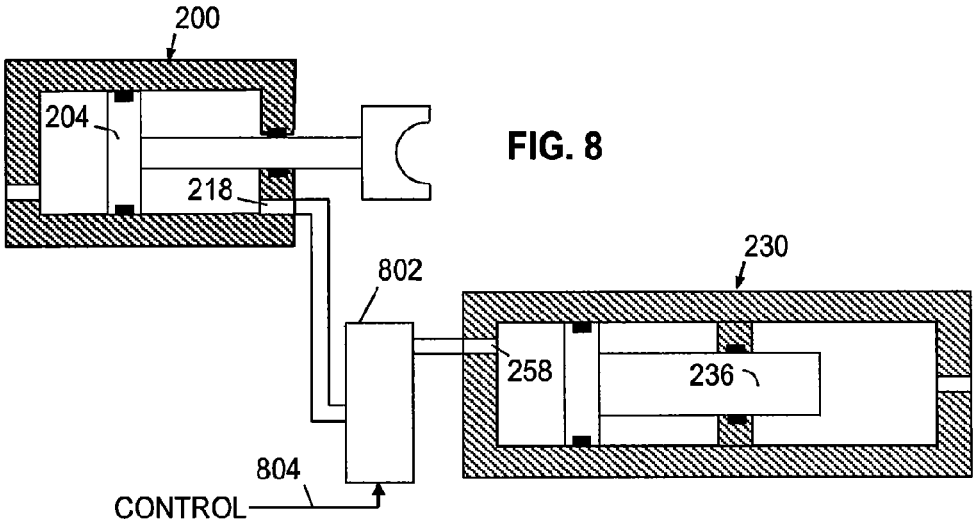
FIG. 8 shows a schematic diagram of a deintensifier switchably coupled to a hydraulic operator in accordance with various embodiments.

FIG. 8 shows a schematic diagram of a deintensifier 230 switchably coupled to the hydraulic operator 200 in accordance with various embodiments. A switch 802 is coupled to the opening port 218 of the operator 200, to the close port 220 of operator 200 (not shown), and to the closing port 258 of the deintensifier 230. In some embodiments, the operator 430 is employed in place of the operator 200, and the switch 802 is coupled to the slack port 462 of the operator 430. The switch 802 includes valves that selectively block fluid flow to/from the operator 200 and the deintensifier 230, or fluidically couple the operator 200 and the deintensifier 230 for fluid communication. A control signal 804 may be provided to the switch 802 to select which of the open or closed positions of the switch are active. The control signal 804 may be electrical, pneumatic, hydraulic, etc. as needed to actuate the valves of the switch 602.

In some embodiments, the control signal 804 may be a pilot fluid pressure indicative of application of opening and/or closing fluid pressure to the operator 200 and/or the deintensifier 230. The hydraulic switch 802 may include detectors (e.g., pressure detectors) that detect the signal and switch the valves of the hydraulic switch 802 to the open position, thereby fluidically coupling the operator 200 and the deintensifier 230. If the control signal 804 indicates no application of opening and/or closing pressure, then the detectors may cause the hydraulic switch 802 to close the valves and block fluid flow to/from the operator 200 and the deintensifier 230. By blocking fluid flow, the switch 802 effectively locks the pistons 204, 234 of the operator 200 and the deintensifier 230 in place. In some embodiments, the operation of the hydraulic switch 802 may serve to replace or supplement mechanical locks associated with the operator 200 and/or the deintensifier 230.

In some embodiments, the switch 802 allows the opening port 218 of the operator 200 be selectively coupled to hydrostatic pressure or another pressure source (e.g., an accumulator), or coupled to the deintensifier closing port 258, thereby allowing the operator 200 to be closed without the aid of the deintensifier 230.

Figure 9:
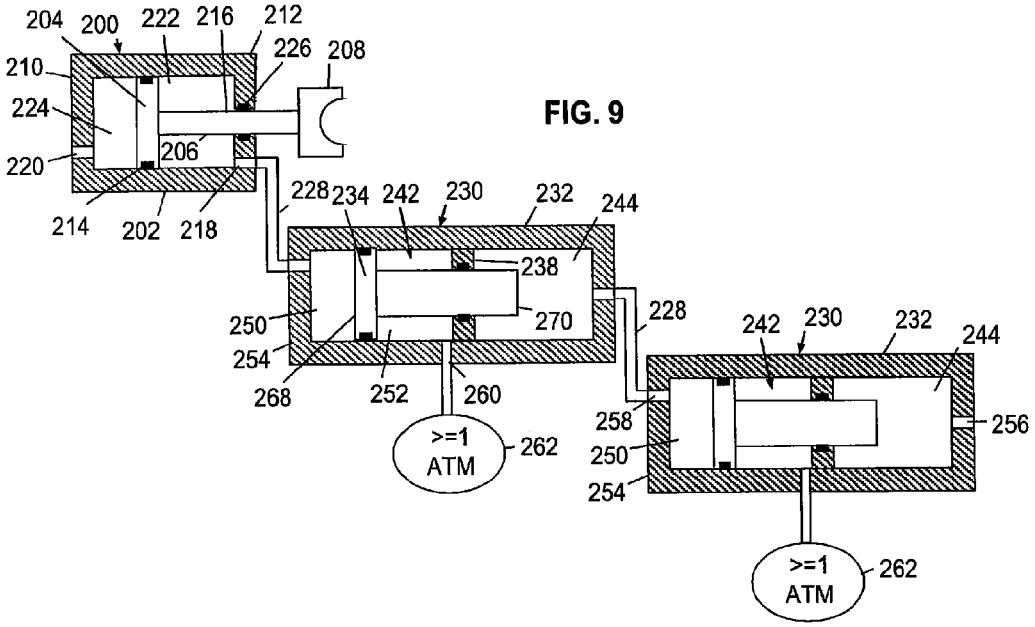
FIG. 9 shows a schematic diagram of an operator with multiple deintensifiers arranged in series.
Figure 10:
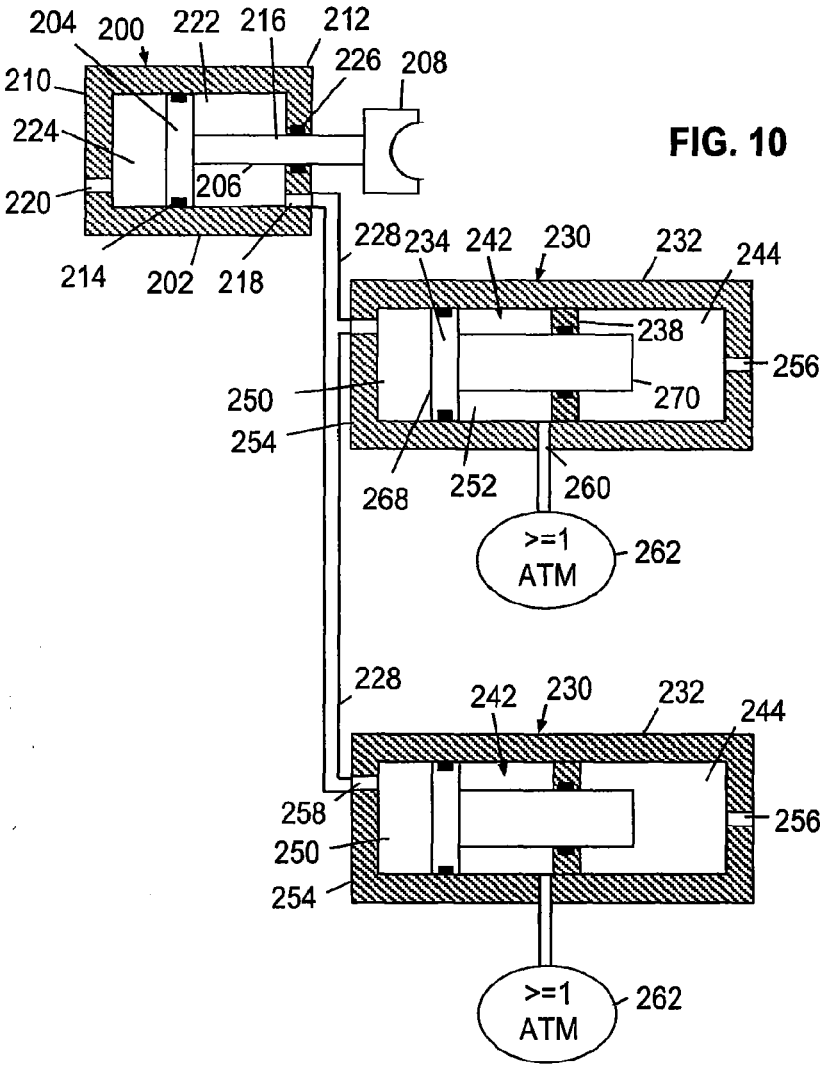
FIG. 10 shows a schematic diagram of an operator with multiple deintensifiers arranged in parallel.

FIGS. 9 and 10 show alternative embodiments of a hydraulic operator 200 with multiple deintensifiers 230. In FIG. 9, the deintensifiers 230 are shown fluidically coupled with the operator 200 in series and in FIG. 10, in parallel. The deintensifiers 230 may also be fluidically coupled in any combination of series and parallel. The ability to use multiple deintensifiers 230 in series allows adjustment of the ratio between deintensifier piston surface 268 and the mandrel surface 270 without having to use a completely different deintensifier 230. The use of multiple deintensifiers 230 in parallel increases the capacity of the deintensifiers 230 to work with different fluid volumes based on the size of the operator. The deintensifiers 230 thus may simply be "stacked" in series, parallel, or combination of both to suit the operational requirements of a given subsea system and create flexibility in supplying appropriate deintensifiers 230. Using multiple deintensifiers also allows for the standardization of the size of the deintensifier 230 to smaller units that may be more easily manufactured.

Figure 11A:
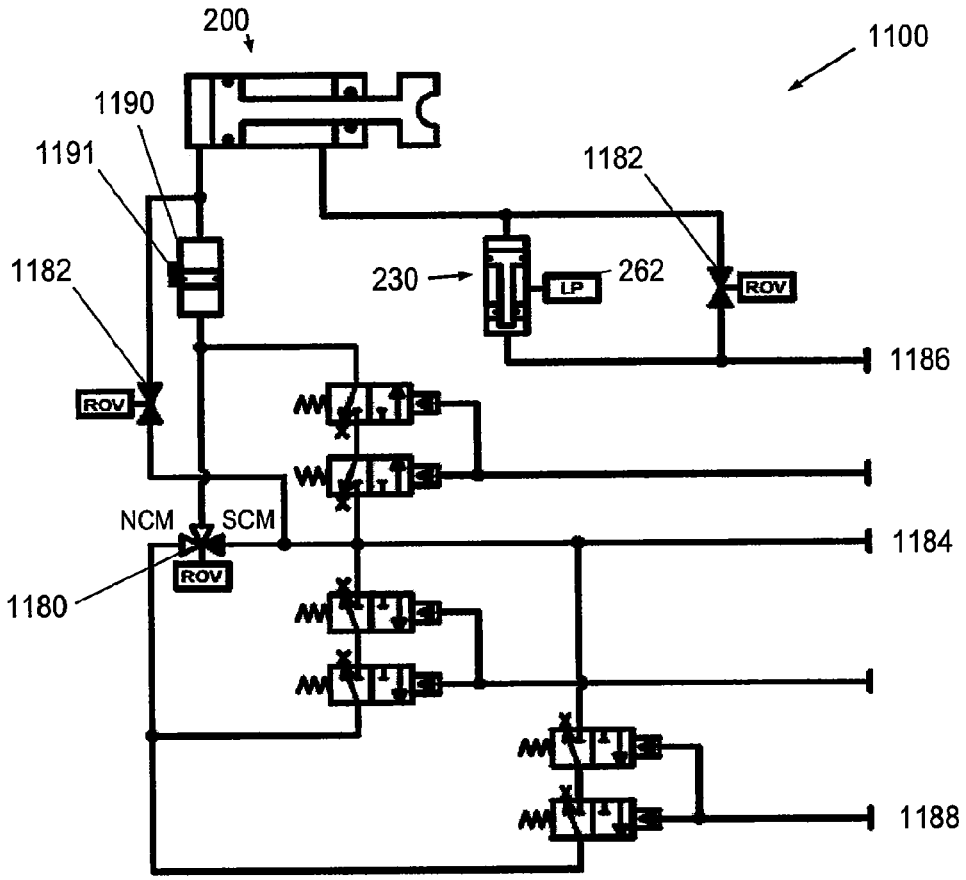
FIGS. 11A-11C show schematic diagrams of embodiments of a control system for an operator and deintensifier configuration.
Figure 11B:
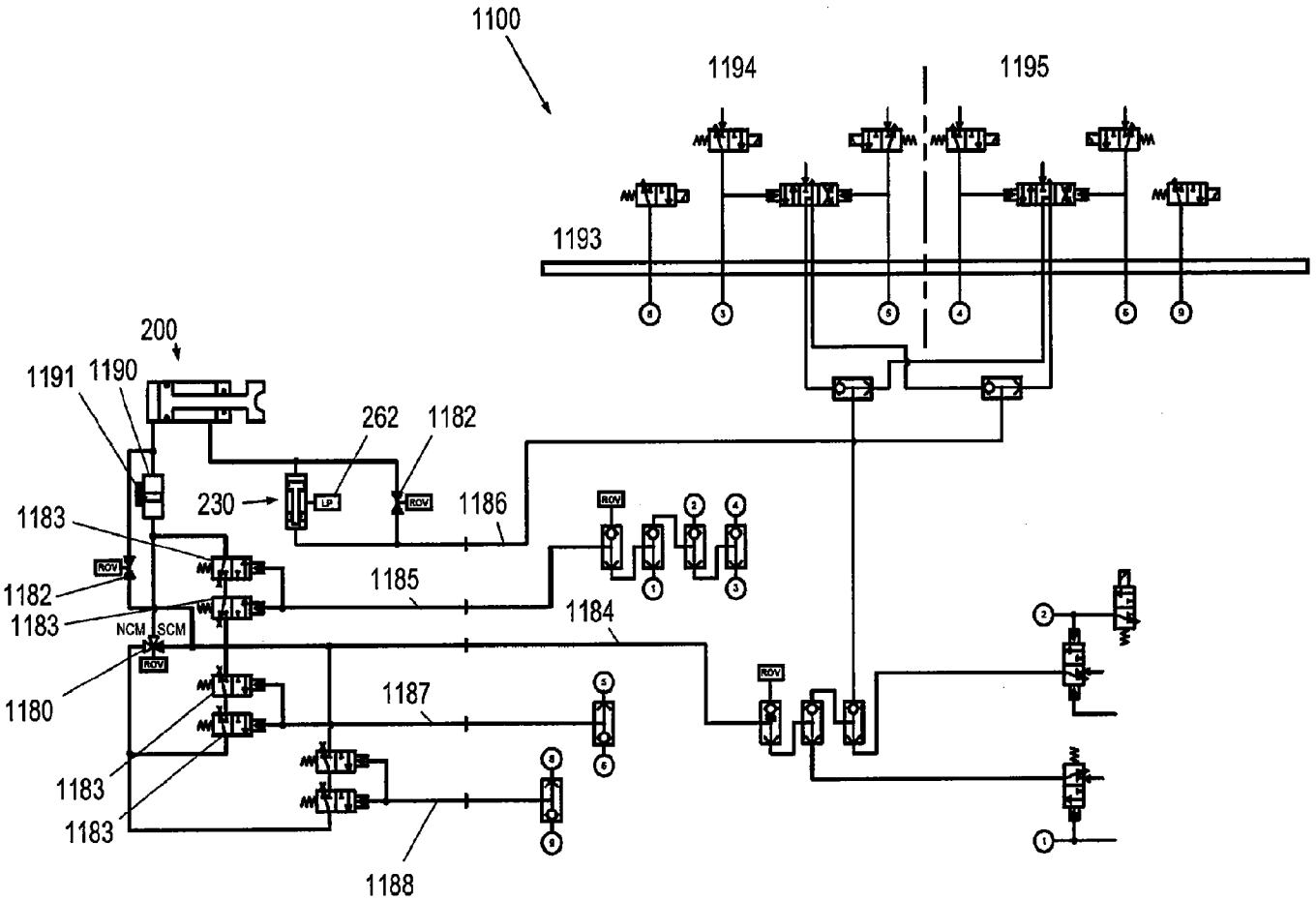
Figure 11C:
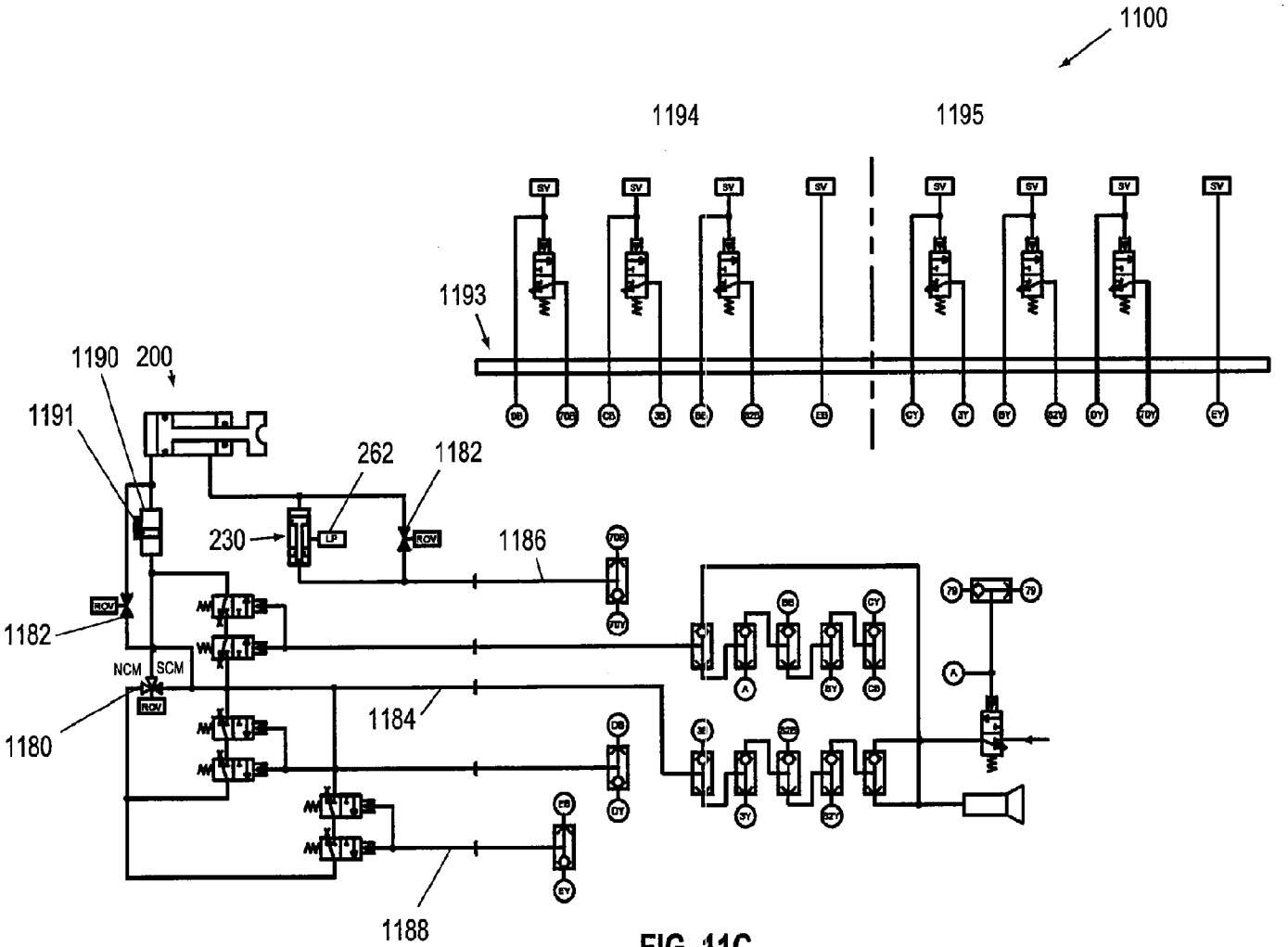

FIGS. 11A-11C show embodiments of a control system 1100 for use with any of the operator and deintensifier configurations discussed in this application. As an example for purposes of explanation, FIGS. 11A-11C show a single operator 200 and deintensifier 230 with chamber 262 as described above. The flow of fluid between the operator 200 and the deintensifier 230 may be regulated by the control system 1100, which comprises switches (i.e. valves) coupled to control sources. For example, the control system 1100 may be a hydraulic control system 1100 using fluid valves coupled to fluid sources, such as subsea accumulators.

The control systems 1100 are used to allow or block the deintensifier function when operating the operator 200 as the system is placed in normal closing mode (NCM) or self closing mode (SCM). In normal closing mode, the deintensifier piston opening surface is fluidically uncoupled from ambient pressure and thus the operator 200 opens and closes under its normal operating systems as if the deintensifier 230 were not being used. In normal closing mode, operator pressure is vented from open and close ports in the operator 200. In the self closing mode, the deintensifier piston opening surface is fluidically coupled to ambient pressure and thus the deintensifier 230 is activated to assist in closing the operator 200.

Specifically with respect to FIG. 11A, to uncouple the deintensifier piston opening surface from ambient pressure, the control system 1100 includes a selector valve 1180 movable between a normal closing mode (NCM) position a self closing mode (SCM) position. The selector valve 1180 may be operated using a remote operated vehicle (ROV). In FIG. 11, the selector valve 1180 is shown in the normal closing mode where the deintensifier piston opening surface is fluidically uncoupled from ambient pressure and thus the operator 200 opens and closes under its normal operating systems as if the deintensifier 230 were not being used. In the self closing mode, the deintensifier piston opening surface is fluidically coupled to ambient pressure and thus the deintensifier 230 is activated to assist in closing the operator 200.

The control system 1100 includes conduits with various switches (e.g., valves) 1183 used appropriately for the different control system circuits desired for different operating conditions of the operator 200 and the deintensifier 230. It should be appreciated that other control system circuits that include less, more, or different conduits than shown as appropriate for different system parameters.

Although controlled in different ways in FIGS. 11A-11C, the control system 1100 includes a conduit 1184 in communication with a close source for closing the operator 200. The control system 1100 also includes a conduit 1186 in communication with an open source for providing open pressure to the deintensifier 230. The open source conduit 1186 connects with the open side of the deintensifier 230 and may be open to ambient pressure or some other pressure source. The close source conduit 1184 connects with a source of closing pressure, such as accumulators 120.

Specifically with respect to FIGS. 11B and 11C, other conduit configurations and switches are used to place the operator 200 and deintensifier 230 in their various modes of operation and supply appropriate control signals or pressures to the equipment.

As an example, FIGS. 11B and 11C show other components on a Lower Marine Riser Package (LMRP) 1193, including control switches in the LMRP Blue Pod 1194 and Yellow Pod 1195. However, the control system 1100 does not need to include valves or switches on an LMRP, as shown for example in FIG. 11A.

In addition to the open conduit 1186 and close conduit 1184, the control system 1100 may also include pilot signal controlled valves 1183 as shown in FIGS. 11B and 11C that are controlled through a close pilot conduit 1185 and an open pilot conduit 1187, respectively. FIGS. 11B and 11C show the integration of the deintensifier basic control system as shown in FIG. 11A into the different control systems.

Although not shown, an accumulator 120 may be selectively fluidically coupled with the closing chamber of the operator housing. In what's known as a dead man/auto shear self closing mode, the control system 1100 may allow closure of the operator piston by fluidically coupling the deintensifier to ambient pressure to close the blowout preventer ram with ambient pressure reduction, after which the control system 1100 fluidically couples the accumulator 120 with the closing chamber so that the high pressure fluid in the accumulator 120 may be released to cut the pipe and seal the well bore. The dead man/auto shear self closing mode may be activated by sending a control signal or pressure through dead man conduit 1188. The activation signal/pressure is used to control valves 1183 adjust the control circuit configuration.

Additionally, the control system 1100 includes one or more bypass valves 1182 capable of allowing fluid pressure to bypass the deintensifier 230 through a bypass conduit. The bypass valve(s) 1182 may be operated using an ROV to create an ROV controlled bypass to bypass the deintensifier 230 in case the deintensifier 230 is not operating properly. A similar ROV access bypass may be included using a bypass valve 1182 to allow ROV access to the close chamber of the operator 200.

As an option, the control systems 1100 may also include an operator piston position indicator system. As shown, the control systems 1100 may include a separator 1190 fluidically coupled with the closing chamber of the operator 200, the separator 1190 including an internal movable element. As the pressure in the closing chamber of the operator 200 adjusts, the position of the internal movable element adjusts accordingly. Also included is a sensor 1191 capable of measuring the position of the internal moveable element and transmitting a signal representing the position. The signal is sent to an instrument capable producing an indication of the position. Since the position of the internal movable element is related to the pressure in the closing chamber of the operator 200, the position of the internal movable element indicates the position of the operator piston within the operator housing. Knowing the position of the internal movable element therefore allows a user to know the position of the operator piston and thus the current state of the BOP. The sensor 1191 may operate using any suitable means, such as magnetic, ultrasonic, laser, or other detection methods.

Figure 12:
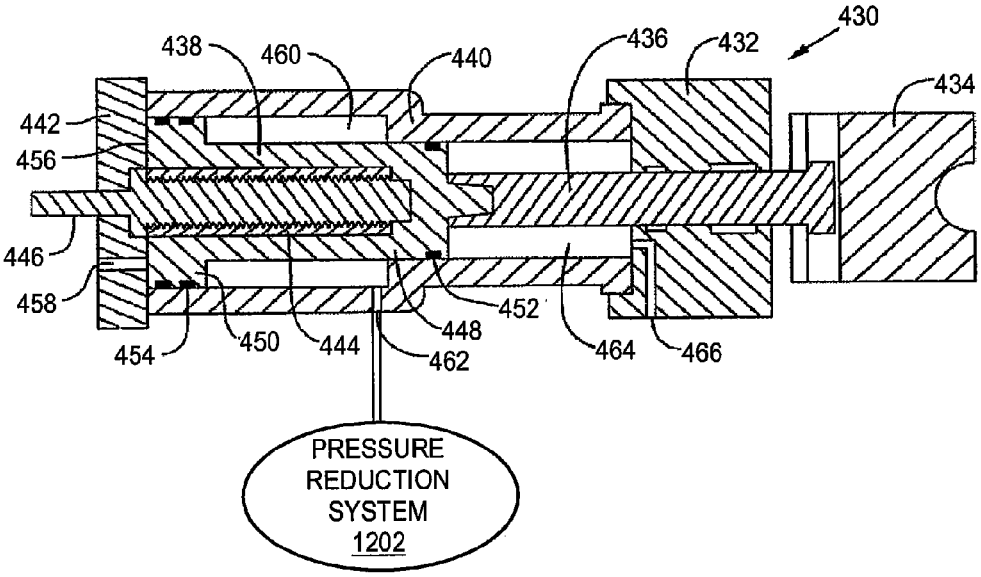
FIG. 12 shows a schematic diagram of a hydraulic operator including a reduced pressure slack chamber in accordance with various embodiments.

FIG. 12 shows a schematic diagram of an operator 430 including a reduced pressure slack chamber 460 in accordance with various embodiments. In FIG. 12, the slack chamber 460 of the hydraulic operator 430 is fluidically coupled to a pressure reduction system 1202 that provides a fluid pressure to the slack chamber 460 that is lower than the ambient fluid pressure when the operator 430 is installed subsea (i.e., lower than hydrostatic pressure). The reduced pressure in the slack chamber 460 increases the pressure differential across the piston flange 450, thereby reducing the fluid pressure that must be provided at the closing port 458 to extend the piston rod 436.

In some embodiments, the pressure reduction system 1202 may include a chamber or accumulator charged to a predetermined pressure (e.g., one atmosphere). If the pressure reduction system 1202 includes a gas-filled chamber (e.g., nitrogen-filled), then the slack chamber 460 will also be gas-filled. Because the slack chamber 460 is hydraulically isolated from the fluid chambers 456, 464, no liquids pass from the slack chamber 460 to the gas-filled chamber. Consequently, such embodiments advantageously require no mechanism for removing liquid from the gas-filled chamber. The pressure of the gas-filled chamber can be predetermined to provide a desired pressure differential across the piston flange 450 at a given operational depth.

In some embodiments, the pressure reduction system 1202 may include a fluid line extending from the slack chamber 460 to the surface or other fluid source. The fluid line may contain a fluid that is less dense than water, thereby reducing the pressure in the slack chamber 406 relative to hydrostatic pressure at the well location. The fluid contained in the fluid line may be liquid (e.g., oil) that is less dense that water, or a pressurized gas, such as nitrogen. Unlike at least some embodiments of the operators 200, 430 disclosed herein, the embodiment of FIG. 12 is not dependent on hydrostatic pressure to tune the closing force. The pressure provided to the slack chamber 460, via the fluid line, is dependent on water depth, even when the fluid line is filled with nitrogen gas. Because the fluid line is charged from the surface, the pressure provided to the slack chamber 460 can be varied over a wide range (e.g., from very low pressure to very high pressure), allowing the pressure in the slack chamber 460 to be tuned in accordance with the operating conditions. The fluid line also allows for monitoring of the pressure in the slack chamber 460. Thus, any ingress of seawater into the slack chamber 460 to be readily identified.

While embodiments of FIG. 12 have been discussed with regard to connection of the pressure reduction system 1202 to the slack chamber 460 of the operator 430, embodiments may also connect the pressure reduction system 1202 to the opening chamber 464 in addition to or in lieu of connection to the slack chamber 460. For both tandem booster operator and standard operator, opening pressure is significantly reduced if both slack chamber and opening chamber are connected, through appropriate valves, to open pressure after usage of the deintensifier system. This effectively allows selecting a bigger ratio between deintensifier piston surface 268 and the mandrel surface 270 and hence increases the closing pressure of the actuator.

Figure 13:
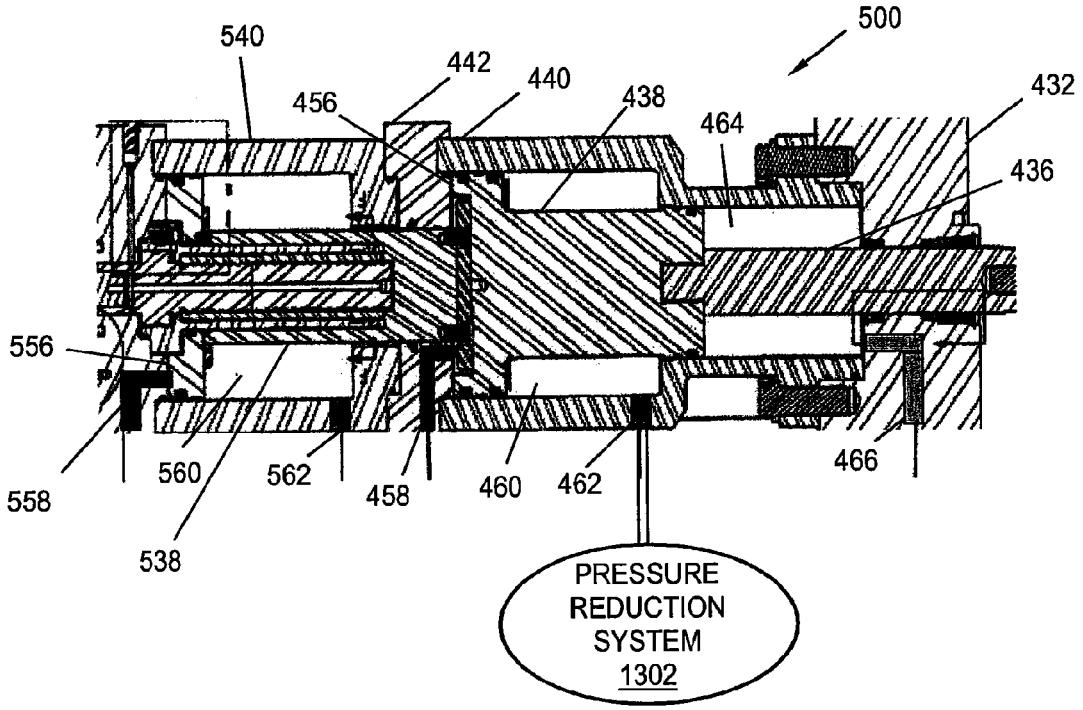
FIG. 13 shows a schematic diagram of another hydraulic operator including a reduced pressure slack chamber in accordance with various embodiments.

FIG. 13 shows an alternative tandem booster operator 500 as discussed above with respect to FIG. 5. As compared to the system shown in FIG. 12, FIG. 13 shows the slack chamber 460 of the operator 500 fluidically coupled to a pressure reduction system 1302 that provides a fluid pressure to the slack chamber 460 that is lower than the ambient fluid pressure when the operator 500 is installed subsea (i.e., lower than hydrostatic pressure). The pressure reduction system 1302 is similar to the pressure reduction system 1202 discussed above with respect to FIG. 12 and likewise, in some embodiments, the pressure reduction system 1302 may include a chamber or accumulator charged to a predetermined pressure (e.g., one atmosphere). The reduced pressure in the slack chamber 460 increases the pressure differential across the operator piston 438, thereby reducing the fluid pressure that must be provided at the closing port 458 to extend the piston rod 436.

Figure 14:
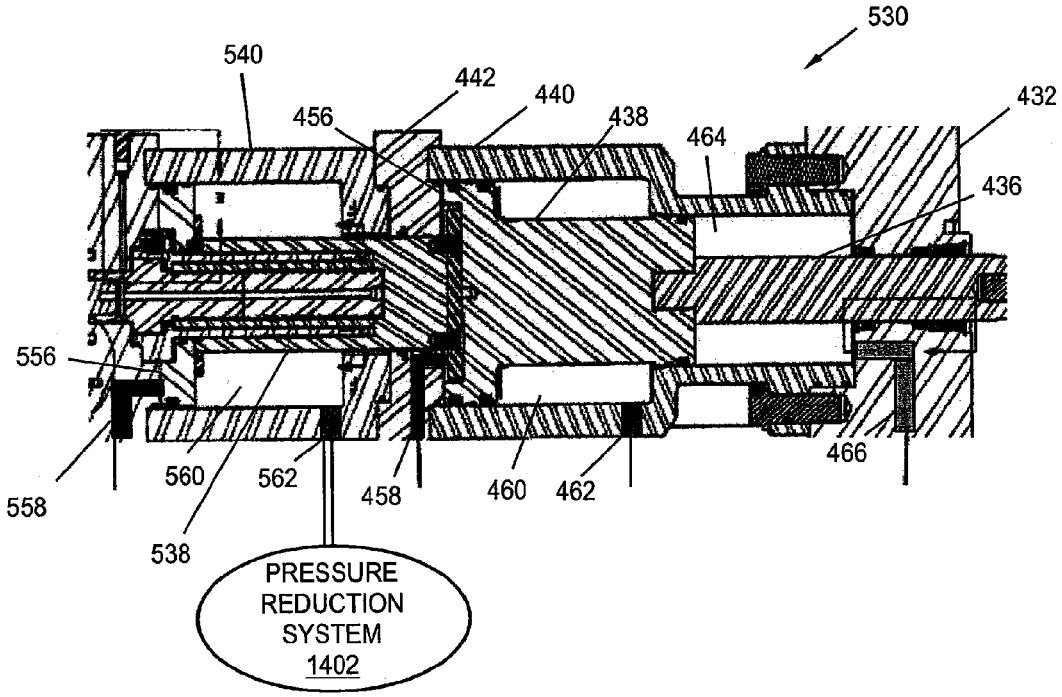
FIG. 14 shows a schematic diagram of yet another hydraulic operator including a reduced pressure slack chamber in accordance with various embodiments.
Figure 15:
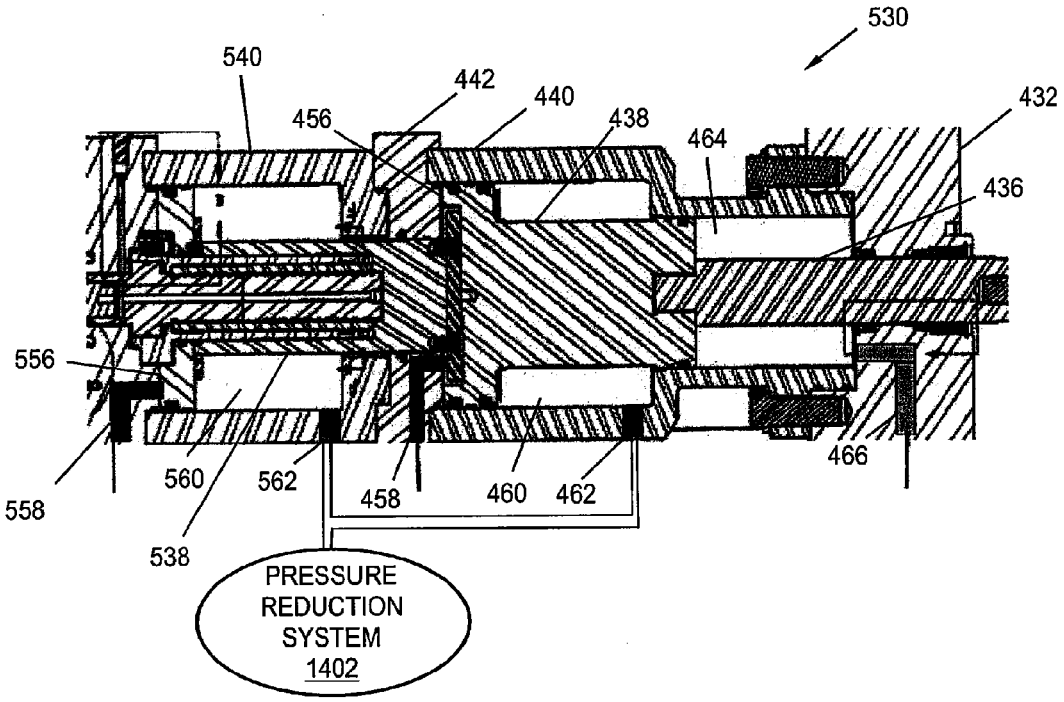
FIG. 15 shows a schematic diagram of yet another hydraulic operator including a reduced pressure slack chamber in accordance with various embodiments.

FIG. 14 shows the same tandem booster 500 as shown in FIG. 13 but with a pressure reduction system 1402 fluidically coupled with the opening chamber 560 of the tandem booster through opening port 562. The pressure reduction system 1402 is similar to the pressure reduction systems 1202, 1302 discussed above and provides a fluid pressure to the opening chamber 560 that is lower than the ambient fluid pressure when the operator 500 is installed subsea (i.e., lower than hydrostatic pressure). Likewise, in some embodiments, the pressure reduction system 1402 may include a chamber or accumulator charged to a predetermined pressure (e.g., one atmosphere). The reduced pressure in the opening chamber 560 increases the pressure differential across the booster piston 538, thereby reducing the fluid pressure that must be provided at the closing port 558 to extend the booster piston 538 and thus the operator piston rod 436. Alternatively, the pressure reduction system 1402 may be fluidically coupled to both the opening chamber 560 and the slack chamber 460 as shown in FIG. 15.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A subsea system, comprising:

an operator, comprising:

an operator housing;

an operator piston movably disposed within the operator housing between and open position and a closed position, the operator piston being sealingly engaged with an inner surface of the operator housing and an inner volume of the operator housing being divided into a closing chamber and a second chamber by the operator piston; and a piston rod coupled to the operator piston and extended from the operator housing; and a deintensifier fluidically coupled to the operator, the deintensifier comprising:

a deintensifier housing comprising an interior;

a deintensifier piston movably disposed within the interior of the deintensifier housing, the deintensifier piston comprising a closing surface fluidically coupled to the second chamber of the operator housing and an opening surface fluidically coupled to ambient pressure; and wherein an area of the closing surface is greater than an area of the opening surface so as to increase the pressure differential between the closing chamber and the second chamber and assist in moving the operator piston to the closed position.

2. The subsea system of claim 1, wherein the deintensifier housing further comprises:

a piston chamber fluidically coupled to the second chamber, the closing surface of the deintensifier piston being disposed in the piston chamber;

a mandrel chamber separated from the piston chamber by an internal wall of the deintensifier housing, the opening surface of the piston being disposed in the mandrel chamber; and a port providing a passage from an interior of the mandrel chamber to an exterior of the deintensifier housing.

3. The subsea system of claim 2, wherein:

the piston further comprises a mandrel extending through the internal wall into the mandrel chamber; and an end of the mandrel comprises the opening surface of the deintensifier piston.

4. The subsea system of claim 2, wherein:

an inner volume of the piston chamber is divided into a deintensifier closing chamber and a deintensifier slack chamber by the deintensifier piston;

the deintensifier slack chamber comprises a port that fluidically couples the deintensifier slack chamber to a pressure source; and the deintensifier closing chamber comprises at least as great a fluid capacity as the second chamber of the hydraulic operator.

5. The subsea system of claim 1, wherein the second chamber of the hydraulic operator is one of an opening chamber and a slack chamber.

6. The subsea system of claim 1, wherein the deintensifier further comprises:

a barrel disposed within the deintensifier housing, an annulus being formed between an outer surface of the barrel and an inner surface of the deintensifier housing; and wherein the deintensifier piston is an annular piston disposed in the annulus, and sealingly engaged with the outer surface of the barrel.

7. The subsea system of claim 6, further comprising:

a closing chamber formed at least partially by the closing surface of the deintensifier piston and the inner surface of the deintensifier housing;

an opening chamber formed at least partially by the opening surface of the deintensifier piston, the outer surface of the barrel, and the inner surface of the deintensifier housing; and the closing chamber comprises at least as great a fluid capacity as the second chamber of the hydraulic operator.

8. The subsea system of claim 1, further comprising a second deintensifier, wherein a ratio of closing surface to opening surface of the second deintensifier piston is greater than a ratio of closing surface to opening surface of the deintensifier piston so as to be able to effectively lock the operator piston in the closed position.

9. The subsea system of claim 8, further comprising a switch configured to couple the second chamber with either one of both the deintensifier or the second deintensifier.

10. The subsea system of claim 1, further comprising:

a switch configured to selectively couple and uncouple the deintensifier with the second chamber of the hydraulic operator; and a detector configured to detect an operating parameter and control the switch on application of a control signal.

11. The subsea system of claim 1, further comprising more than one deintensifier.

12. The subsea system of claim 11, wherein the deintensifiers are fluidically coupled in series, in parallel, or any combination of series and parallel.

13. The subsea system of claim 1, further comprising a control system configured to selectively fluidically uncoupling the deintensifier piston opening surface from ambient pressure.

14. The subsea system of claim 13, wherein the control system further comprises a selector valve movable between a normal closing mode position where the deintensifier piston opening surface is fluidically uncoupled from ambient pressure and a self closing mode position where deintensifier piston opening surface is fluidically coupled to ambient pressure.

15. The subsea system of claim 14, further comprising:

an accumulator selectively fluidically coupled with the closing chamber of the operator housing;

wherein the control system is configured to operate in a dead man/auto-shear self closing mode wherein the control circuit allows closure of the operator piston by fluidically coupling the deintensifier to ambient pressure and then fluidically coupling the accumulator with the closing chamber.

16. The subsea system of claim 13, further comprising a bypass valve configured to allow fluid pressure to bypass the deintensifier through a bypass conduit.

17. The subsea system of claim 13, further comprising:

a separator fluidically coupled with the closing chamber of the operator housing, the separator comprising an internal movable element; and a sensor capable of measuring the position of the internal moveable element and transmitting a signal representing the position.

18. The subsea system of claim 1, further comprising a blowout preventer, wherein the piston rod is coupled to a ram of the blowout preventer.

19. The subsea system of claim 1, wherein ambient pressure is hydrostatic pressure.

20. A method of operating a subsea system, comprising:

deintensifying ambient subsea pressure across a deintensifier piston by exposing only an opening surface of the deintensifier piston to the ambient subsea pressure, the opening surface comprising a smaller surface area than a closing surface of the deinstensifier piston; and communicating the deintensified ambient subsea pressure from the deintensifier piston to an opening side of an operator piston to increase the pressure differential across the operator piston and move the operator piston towards a closed position.

21. The method of claim 20, further comprising applying a closing pressure to a closing side of the operator piston to move the operator piston towards the closed position.

22. The method of claim 21, further comprising applying the closing pressure from a subsea accumulator.

23. The method of claim 21, wherein communicating the deintensified ambient subsea pressure further comprises decreasing the amount of closing pressure needed to move the operator piston towards the closed position compared to communicating ambient subsea pressure.

24. The method of claim 21, further comprising applying the closing pressure after communicating the deintensified ambient subsea pressure.

25. The method of claim 20, further comprising controlling the communication of the deintensified ambient subsea pressure to the operator piston.

26. The method of claim 20, further comprising moving a piston rod coupled to the operator piston.

* * * * *